US011167252B2

(12) United States Patent
Fernandez Orive et al.

(10) Patent No.: US 11,167,252 B2
(45) Date of Patent: Nov. 9, 2021

(54) SOLID COMPONENT MIXING APPARATUS AND ASSOCIATED METHOD

(71) Applicant: Loramendi, S. Coop., Vitoria-Gasteiz (ES)

(72) Inventors: Luis Alfonso Fernandez Orive, Vitoria-Gasteiz (ES); Alesander Olea Abarrategi, Igorre (ES)

(73) Assignee: LORAMENDI, S. COOP., Vitoria-Gasteiz (ES)

( * ) Notice: Subject to any disclaimer, the term of this patent is extended or adjusted under 35 U.S.C. 154(b) by 401 days.

(21) Appl. No.: 16/451,268

(22) Filed: Jun. 25, 2019

(65) Prior Publication Data

US 2019/0314775 A1 Oct. 17, 2019

Related U.S. Application Data

(63) Continuation of application No. PCT/ES2018/070061, filed on Jan. 26, 2018.

(30) Foreign Application Priority Data

Feb. 7, 2017 (EP) ..... 17382051

(51) Int. Cl.
*B01F 3/18* (2006.01)
*B01F 5/24* (2006.01)
*B01F 15/00* (2006.01)
(Continued)

(52) U.S. Cl.
CPC ..... *B01F 3/182* (2013.01); *B01F 5/241* (2013.01); *B01F 15/00883* (2013.01);
(Continued)

(58) Field of Classification Search
CPC ..... B01F 15/00915; B01F 15/0429; B01F 2215/0044; B01F 3/182; B01F 5/241; B65D 88/66
(Continued)

(56) References Cited

U.S. PATENT DOCUMENTS

X477361 6/1892 Gray
1,369,248 A * 2/1921 Krause ..... B01F 5/241 366/181.1
(Continued)

FOREIGN PATENT DOCUMENTS

EP 3357567 B1 * 4/2020 ..... B22C 5/0481
GB 242596 A 12/1925
(Continued)

OTHER PUBLICATIONS

International Search Report and Written Opinion in corresponding International Application No. PCT/ES2018/070061; dated Jun. 6, 2018, 11 pages.
(Continued)

*Primary Examiner* — Tony G Soohoo
(74) *Attorney, Agent, or Firm* — Edell, Shapiro & Finnan, LLC

(57) ABSTRACT

According to one embodiment a solid component mixing apparatus is provided that includes a mixing device, a first dosing device for supplying sand and a second dosing device for supplying a solid additive that are communicated with the mixing device. The mixing device includes a vertical mixing chamber with a rectangular cross-section, the contour of the chamber being formed by four side walls, such that two side walls opposite one another are wider than the other two walls. The chamber includes a first inlet communicated with the first dosing device and a second inlet communicated with the second dosing device, the second inlet being at a lower height than the first inlet, and the second inlet being arranged in one of the wider side walls of the chamber. Associated mixing methods are also provided.

20 Claims, 4 Drawing Sheets

(51) Int. Cl. *B22C 5/04* (2006.01) *B01F 15/04* (2006.01)

(52) U.S. Cl.
CPC .... *B01F 15/00915* (2013.01); *B01F 15/0429* (2013.01); *B22C 5/0481* (2013.01); *B01F 2215/0044* (2013.01)

(58) Field of Classification Search
USPC ..... 366/183.1, 183.2
See application file for complete search history.

(56) References Cited

U.S. PATENT DOCUMENTS 3,572,654 A * 3/1971 Jaeger ..... B01F 5/241 366/162.1
3,574,344 A * 4/1971 Wallace ..... B01F 15/0445 366/132
3,603,567 A * 9/1971 Sackett, Sr. ..... B01F 13/1002 366/141
3,879,021 A 4/1975 Gerald
3,920,223 A 11/1975 Krueger
4,148,100 A * 4/1979 Moller ..... B01F 15/0201 366/156.1
4,354,622 A * 10/1982 Wood ..... G05D 7/0605 222/55
5,020,695 A * 6/1991 de Almeida Thompson ..... B01F 3/182 222/185.1
5,104,229 A * 4/1992 Paul ..... B01F 5/242 366/101
5,240,328 A * 8/1993 Krambrock ..... B01F 5/242 366/341
5,843,513 A * 12/1998 Wilke ..... A23L 13/432 426/646
6,057,514 A * 5/2000 Maguire ..... B29B 7/283 177/105
6,774,318 B2 * 8/2004 Beal ..... G01G 13/18 177/105
8,974,109 B2 * 3/2015 Gauvin ..... B01F 15/0445 366/141
9,475,596 B2 * 10/2016 Fux ..... G01G 13/02
2008/0267004 A1 * 10/2008 Deters ..... B29B 7/603 366/141
2019/0314775 A1 * 10/2019 Fernandez Orive ..... B01F 15/00915

FOREIGN PATENT DOCUMENTS

JP S4614675 Y1 5/1971
JP 2005238263 A 9/2005
WO WO-9834721 A1 * 8/1998 ..... B01F 5/241

OTHER PUBLICATIONS

Extended European Search Report in Corresponding European Application No. 17382051.5, dated Aug. 1, 2017, 6 pages.

* cited by examiner

SOLID COMPONENT MIXING APPARATUS AND ASSOCIATED METHOD

CROSS-REFERENCE TO RELATED APPLICATIONS

This application relates to and claims the benefit and priority to International Application No. PCT/ES2018/070061, filed Jan. 26, 2018, which relates to and claims the benefit and priority to European Application No. EP17382051.5, filed Feb. 7, 2017.

TECHNICAL FIELD

The present invention relates to solid components mixing apparatus, particularly for preparing the material used for making sand cores, and to an associated mixing method.

BACKGROUND

In cores known as sand cores, sand is the main component thereof. However, a core is not made up of sand alone, but rather comprises another type of components that are mixed with the sand before making the cores, the material resulting from said mixing being the material used for making the cores. In some cases, the sand is mixed with at least one solid component (an additive), and both components (along with others, if there are any) are mixed in a mixing apparatus suitable for such purpose.

The most common mixing apparatus are those in which the components to be mixed are introduced in a vessel either individually or all together through one and the same conduit as disclosed, for example, in U.S. Pat. No. 3,920,223 A. In this latter case, despite the fact that the components arrive through one and the same conduit, they are not mixed together when they do so because the function of the conduit is to simply direct the components to the vessel. After that, the components present in the vessel are mixed, generally using blades. The components are usually supplied in a controlled manner, the required amount being dosed in each case.

This type of mixing requires a certain amount of time to perform, once the components are in the vessel, and this means, in addition to the direct drawback in terms of productivity, that the components will be exposed during said certain amount of time to mechanical friction generated by contact with the blades (or equivalent mechanical elements) in charge of moving and mixing them. These frictions cause the components and/or the resulting mixture to heat up, which must be taken into account in some cases so that they do not deteriorate or negatively modify the properties thereof.

Patent document JP2005238263A discloses another type of mixing, where two component dosing devices are arranged next to one another and both devices are arranged on a conveyor belt. The dosing device arranged upstream in the forward movement direction of the conveyor belt supplies a first component on said belt, and the belt causes the forward movement of said first component in said forward movement direction. The other dosing device supplies the second component to the belt, which is deposited on the first component already arranged on said belt, and both components are thus supplied together and mixed, when required, by means of said belt. Both components are deposited in an additional mixer to assure mixing.

Patent document GB242596A discloses an apparatus for mixing cement and fibrous material, the apparatus comprising a mixing device and a first dosing device for supplying fibrous material and a second dosing device for supplying cement that are communicated with the mixing device. The mixing device comprises a vertical mixing chamber with a rectangular cross-section, the contour of the mixing chamber therefore being formed by four side walls, such that two side walls opposite one another are wider than the other two side walls opposite one another, the mixing chamber having a first inlet communicated with the first dosing device, and a second inlet communicated with the second dosing device, the second inlet being at a lower height than the first inlet, and said second inlet being arranged in one of the wider side walls of the mixing chamber.

SUMMARY

A first aspect of the present disclosure relates to an apparatus that is suitable for mixing sand and a solid additive, which make up the material used for making sand cores. The apparatus comprises a mixing device, a first dosing device for supplying the sand (or other equivalent granular component) to the mixing device, and a second dosing device for supplying the solid additive (a second solid component) to the mixing device.

The mixing device comprises a vertical mixing chamber having a rectangular cross-section, the contour of the mixing chamber therefore being formed by four side walls, such that two side walls opposite one another are wider than the other two side walls opposite one another.

The mixing chamber further comprises a first inlet communicated with the first dosing device to receive the sand, and a second inlet communicated with the second dosing device to receive the solid additive. The second inlet is at a lower height than the first inlet and is furthermore arranged in one of the wider side walls of the mixing chamber.

Therefore, since the mixing chamber is vertical, the force of gravity is utilized to perform mixing, which helps to not require additional mechanical elements to that end. Furthermore, both the sand and the solid additive are forced to come into contact with one another and mix together in a simple and easy manner and without having to use additional mechanical elements such as blades or mixers of another type, for example, achieving the required mixture, or in the simplest case, achieving at least a pre-mixture between both components which must subsequently come into contact with one of said elements for a shorter time for a final mixing.

The smaller the width of the cross-section the more the mixture is assured, but, at the same time, it has to be enough to allow the passage of both components. If the mixing chamber had another type of cross-section, such as a circular section, for example, a correct mixture or pre-mixture between both components could not be assured because it would not be possible to assure that the two components were mixed in the mixing chamber. For example, the solid additive could "push" the sand instead of mixing with it, or while the sand falls down through the mixing chamber, the sand, or at least some of the sand, may not reach the section where the solid additive enters through where it is required, complete correct mixing not being assured (which can give rise to defective parts of the core that is subsequently made), such that either a correct mixture would not be obtained or the obtained mixture would subsequently require a longer mixing time with mechanical elements.

Therefore, in order to carry out a suitable mixture, it is essential for the cross-section through which the sand and the solid additive pass is narrow and elongated, hence said section is defined as a "rectangular section" because it is the definition that best fits those features. In any case, it is evident that in the context of the invention any section having two long sides and two short sides would fit under the definition of "rectangular section", regardless of whether or not said sides formed a section with right angles. Thus, for example, a section in the form of a rectangle with rounded edges or an elongated oval section would also fit under the definition of "rectangular section". Likewise, when referring to the four side walls forming the contour of the sealing chamber, it is clear in the context of the present disclosure that it is not indispensable for the sealing chamber to have walls separated by vertexes, but rather the most important is for there to be two opposite walls (two opposite faces) attached to one another by means of two narrower walls to generate a cross-section through which the sand and the solid additive with the discussed features pass.

The apparatus further comprises a baffle that is suitable for directing the sand towards the wall of the mixing chamber comprising the second inlet.

A second aspect of the present disclosure relates to a mixing method for preparing the material used for making sand cores in an apparatus according to the first aspect of the invention.

Sand and at least one solid additive are mixed with one another in the method, and for the purpose of mixing them, the sand and the solid additive are supplied to a vertical mixing chamber from a sand dosing device and a solid additive dosing device, respectively. The mixing chamber comprises a rectangular cross-section, the contour of the mixing chamber therefore being formed by four side walls, such that two side walls opposite one another are wider than the other two side walls opposite one another. The solid additive is supplied to the mixing chamber through an inlet present in one of the wider side walls of the mixing chamber and at a lower height than the height from which the sand is supplied, the same advantages as those discussed for the first aspect of the invention thereby being obtained.

These and other advantages and features will become evident in view of the drawings and detailed disclosure.

DETAILED DISCLOSURE OF THE INVENTION

A first aspect of the invention refers to a mixing apparatus 100 which is suitable for mixing different solid components with one another and thereby generating a mixture that is subsequently used for making sand cores. The components to be mixed with the apparatus 100 are at least one sand and one solid additive (which can be wood flour or starch, for example).

Figure 1A:
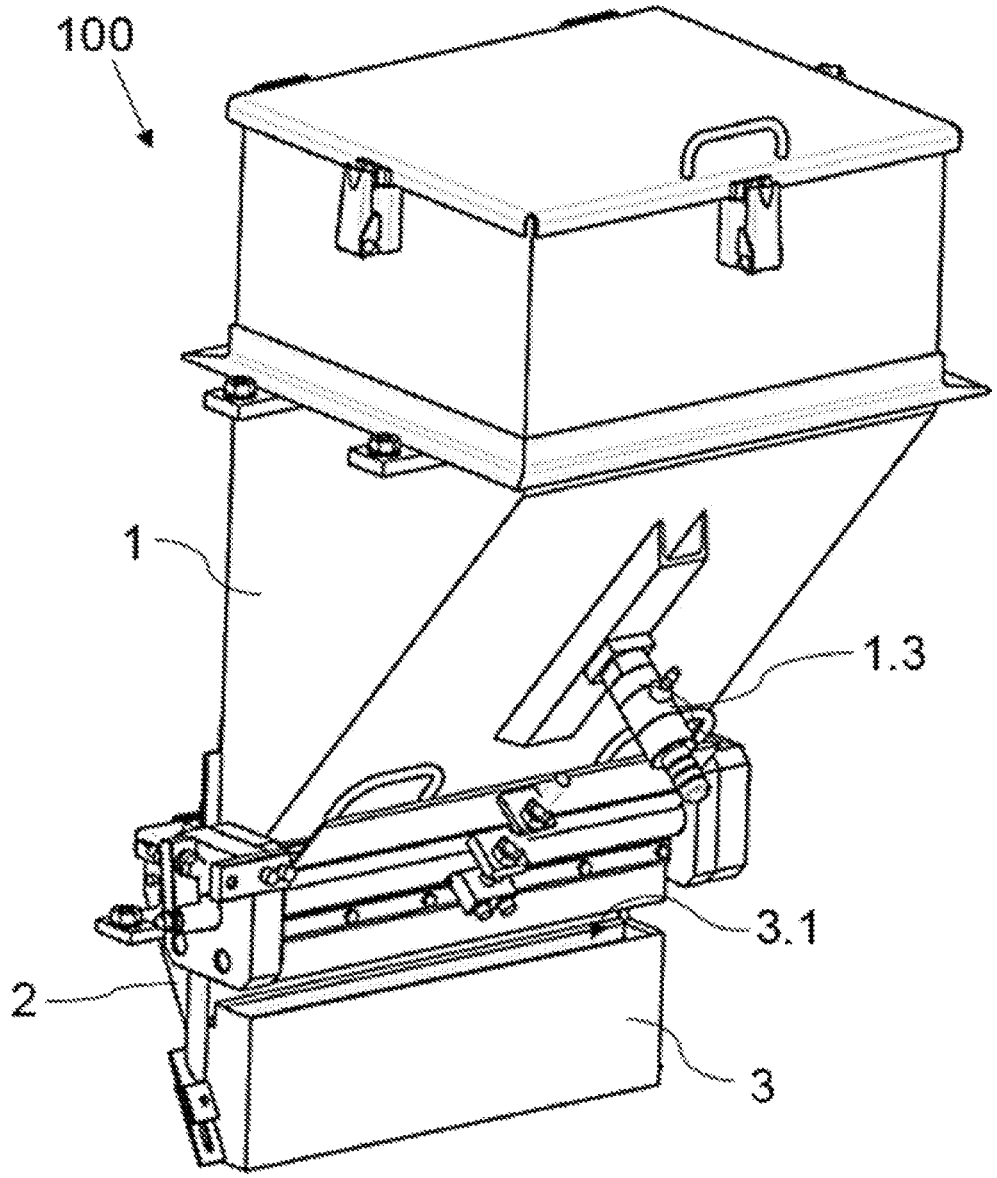
FIGS. 1A and 1B show two perspective views of an embodiment of a mixing apparatus without an attachment element between the first dosing device and the mixing chamber of the mixing apparatus.
Figure 1B:
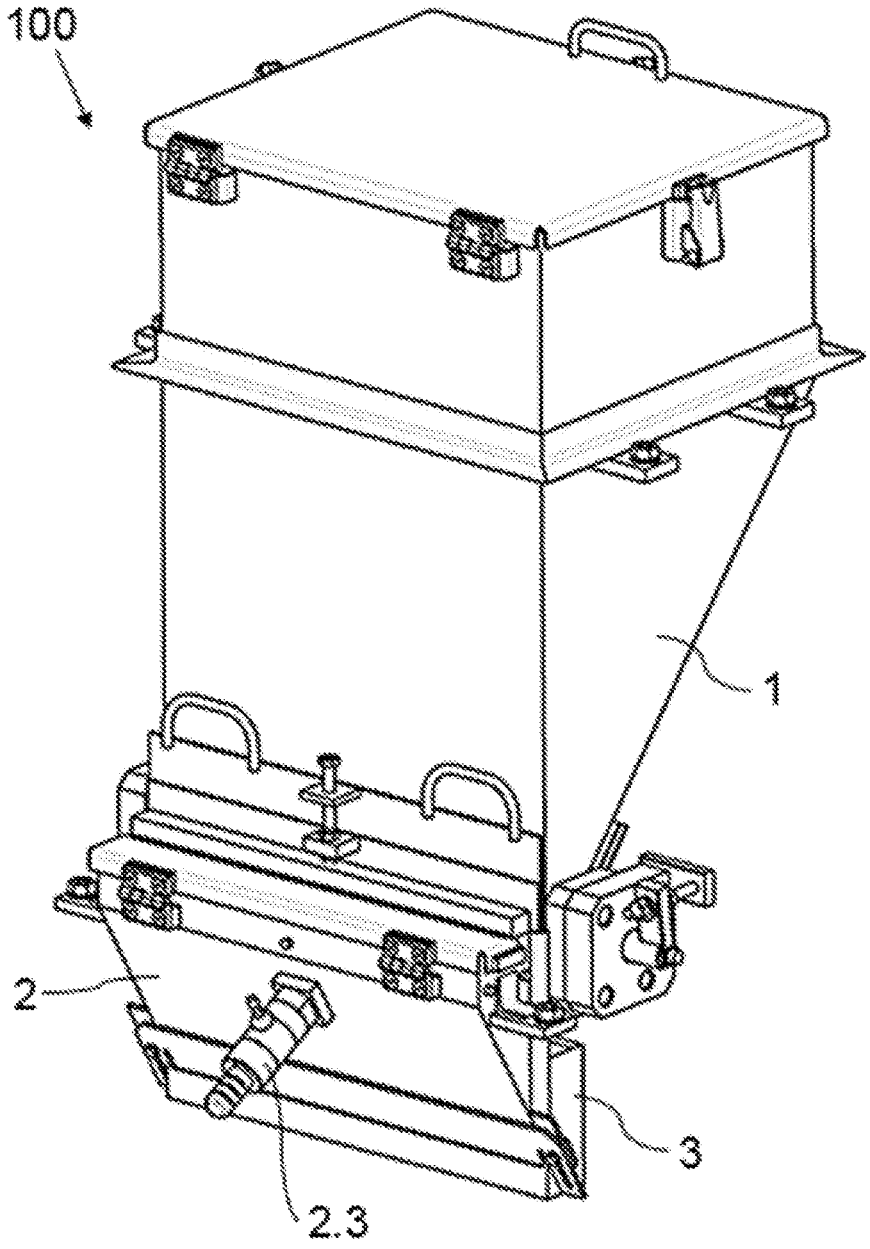

The apparatus 100 comprises a mixing device and a dosing device for each component participating in the desired mixture. In the embodiment shown in the figures, the apparatus 100 comprises a first dosing device 1 for supplying sand (a first solid component) to the mixing device and a second dosing device 2 for supplying a solid additive (a second solid component) to the mixing device, so that both components are mixed with one another in said mixing device, as shown by way of example in FIGS. 1A and 1B. In the case of using more than one sand and/or more than one solid additive, the apparatus 100 would comprise an additional dosing device for each additional component.

The mixing device comprises a vertical mixing chamber 3 having a rectangular cross-section, the contour of the mixing chamber 3 therefore being formed by four side walls, such that two side walls opposite one another are wider than the other two side walls opposite one another.

As indicated, in the context of the invention "rectangular section" must be interpreted as any narrow and elongated cross-section, the rectangular shape being the most representative shape of that definition. However, other shapes such as an oval shape or a rectangular shape with rounded ends, just to mention two examples, would fit under the definition of "rectangular section". Likewise, although it has been established that the contour of the mixing chamber 3 comprises four side walls, it is clear that in the context of the invention these walls can be less defined, as in the case of a cross-section of oval shapes, for example, where the four walls are not separated by vertexes, but where it can clearly be interpreted which ones are the wider two side walls opposite one another.

Figure 2:
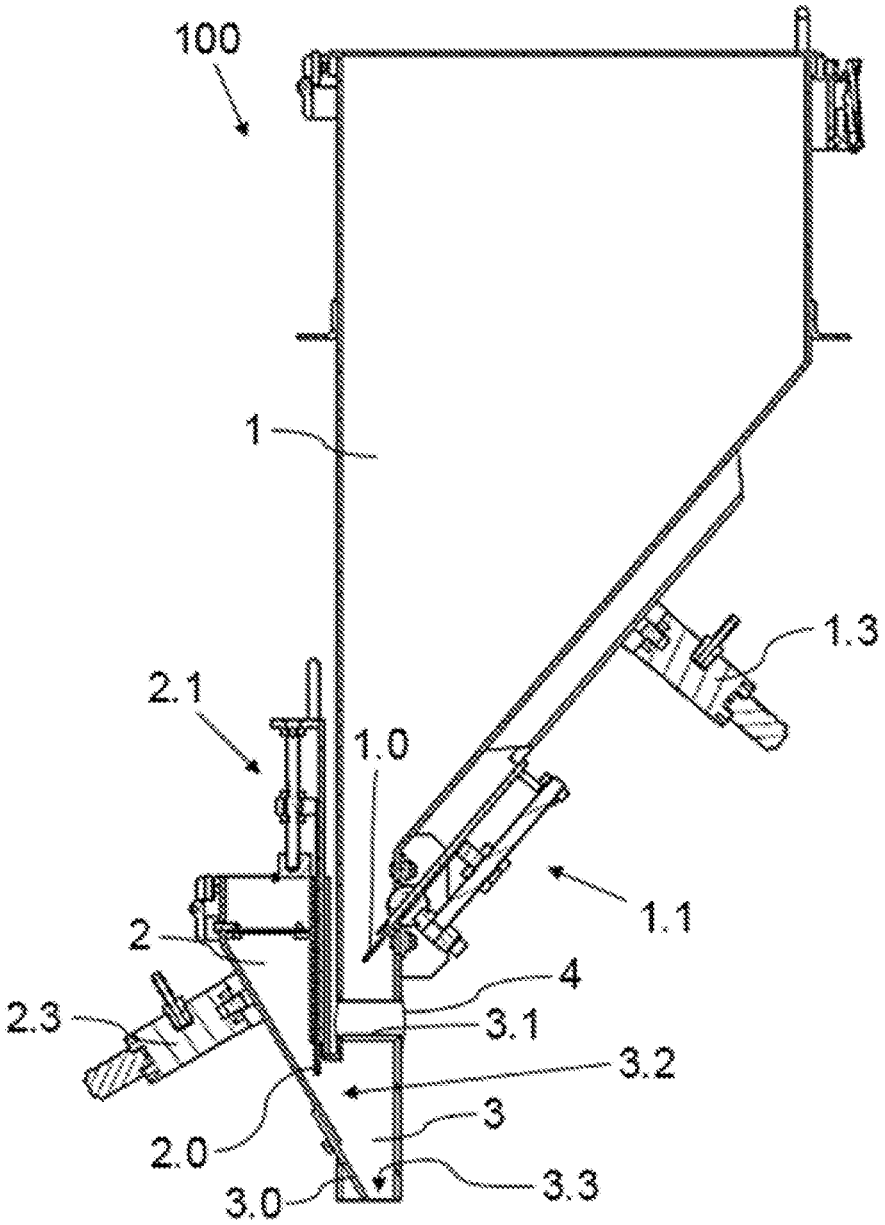
FIG. 2 shows a section view of the mixing apparatus of FIGS. 1A and 1B, with the passage of the dosing devices of the apparatus open.

As shown in FIG. 2, for example, the mixing chamber 3 further comprises a first inlet 3.1 communicated with the first dosing device 1 to receive the sand, and a second inlet 3.2 communicated with the second dosing device 2 to receive the solid additive. The second inlet 3.2 is at a lower height than the first inlet 3.1 and is furthermore arranged in one of the wider side walls of the mixing chamber 3.

In some embodiments, the apparatus 100 comprises a baffle 1.0 which is attached to the first dosing device 1 and is suitable for directing the sand towards the wall of the mixing chamber 3 comprising the second inlet 3.2. The sand is therefore forced to come into contact with the solid additive as soon as said solid additive enters the mixing chamber 3. Due to the force with which the sand falls due to gravity, said sand entrains the solid additive with it, mixing with it.

In some embodiments, in addition to the baffle 1.0 the apparatus 100 further comprises an additional baffle 3.0 which is attached to the second dosing device 2 and at least partially housed in the mixing chamber 3, through the second inlet 3.2. The sand directed by the baffle 1.0 falls onto said additional baffle 3.0, entraining the solid additive arranged on it, assuring to a greater extent a correct mixture between both components (sand and solid additive). Furthermore, the additional baffle 3.0 is suitable for directing the solid additive towards the wall of the mixing chamber 3 opposite the wall comprising the second inlet 3.2, and since said solid additive is already in contact with the sand, it is the mixture between the sand and the solid additive that is directed towards said wall. The additional baffle 3.0 further limits the smaller width of the cross-section of the mixing chamber 3 in a passage area 3.3 of said mixing chamber 3 (the passage area 3.3 is the space left between the end of the additional baffle 3.0 and said wall of the mixing chamber 3), such that due to the narrowness of said passage area 3.3, the correct mixture between both components is assured to an even greater extent given that they are forced to pass through said passage area 3.3 together. It must furthermore be taken into account that when they reach said passage area 3.3, both components have already traveled the path together (regardless of how small it may be).

Generally, the sand used comprises a density greater than the solid additive used (a normal ratio can be about 1.6 kg/dm3 to about 0.4 kg/dm3), which helps the sand entrain the solid additive as a result of the force with which the first component reaches the baffle 3.0 due to the force of gravity, thereby assuring to a greater extent said entrainment, thereby further assuring to a greater extent the correct mixture between both (which is further assured with the passage area 3.3 through which they subsequently pass).

In some embodiments, the apparatus 100 comprises a first regulating device 1.1 for adjusting, as required, the flow of sand at the outlet of the first dosing device 1, and a second regulating device 2.1 for adjusting, as required, the flow of solid additive at the outlet of the second dosing device 2. The amount of each of these two components to be supplied can thereby be adjusted, the apparatus 100 for making cores of different sizes, shapes and/or properties thus being able to be readily configured.

Each of the dosing devices 1 and 2 is adjusted for supplying the amount of sand or solid additive required in a certain amount of time, such that a suitable proportion between the sand and the solid additive is achieved throughout the making process. For example, if 50 kg of sand is required to be mixed with 300 g of solid additive, the outlets of both dosing devices 1 and 2 are adjusted with the respective regulating devices 1.1 and 2.1, so that they can supply the required amount in each case, in one and the same time interval, to assure a correct proportion between both in the entire mixture. Therefore, to the extent possible the mixture of the solid additive with the sand (the material for making cores) is homogenous, and the core made with said mixture of components is homogenous in terms of material, without having areas that are weaker than others because the sand/solid additive proportion varies from some parts of the core to others.

In some embodiments, the apparatus 100 comprises a load cell (or an equivalent element) in at least one of the dosing devices 1 and 2, preferably in both, to know the amount of component present in the dosing device 1 and 2. This further allows facilitating the process of loading the dosing devices 1 and 2, in which the desired amount of the corresponding component can be loaded in an easy manner. For example, it is possible to load a dosing device 1 and 2 until it is detected that the required amount has already been loaded, at which time said loading can be stopped. As a result, the required amount of component is available in each dosing device 1 and 2 in order to subsequently obtain the required mixture as a result of the mixing chamber 3.

In a preferred embodiment of the apparatus 100, the first dosing device 1 is arranged above the mixing chamber 3 and comprises an outlet segment 1.8 with a cross-section equal to the cross-section of the mixing chamber 3 and opposite an upper face of said mixing chamber 3, the first inlet 3.1 of the mixing chamber 3 being arranged on said upper face. The first regulating device 1.1 comprises a movable regulating element demarcating the passage width between its end and the wall of the outlet segment 1.8 opposite said end, said wall being substantially aligned with the wall of the mixing chamber 3 comprising the second inlet 3.2. For adjusting the flow of sand said regulating element is moved by moving its end closer to or farther away from its opposite wall. In said embodiments, the baffle 1.0 attached to the first dosing device 1 and the regulating element of the first regulating device 1.1 are one and the same element, such that the sand is directed where desired (baffle function) and with the desired flow (regulating function) with one and the same element.

The second regulating device 2.1 comprises a movable regulating element 2.0 that is at least partially opposite the second inlet 3.2, for adjusting the outflow of the solid additive, partially covering said second inlet 3.2 from above to perform said adjustment, thereby limiting the area of said second inlet 3.2 through which solid additive is supplied.

In some embodiments of the apparatus 100, as shown in the figures, for example, the first regulating device 1.1 is attached to the first dosing device 1 with rotational freedom, thus being suitable for adjusting the flow of the corresponding component, or for participating in the adjustment by means of the rotation thereof. In other embodiments, the second regulating device 2.1 could also be attached to the second dosing device 2 with rotational freedom.

Figure 3:
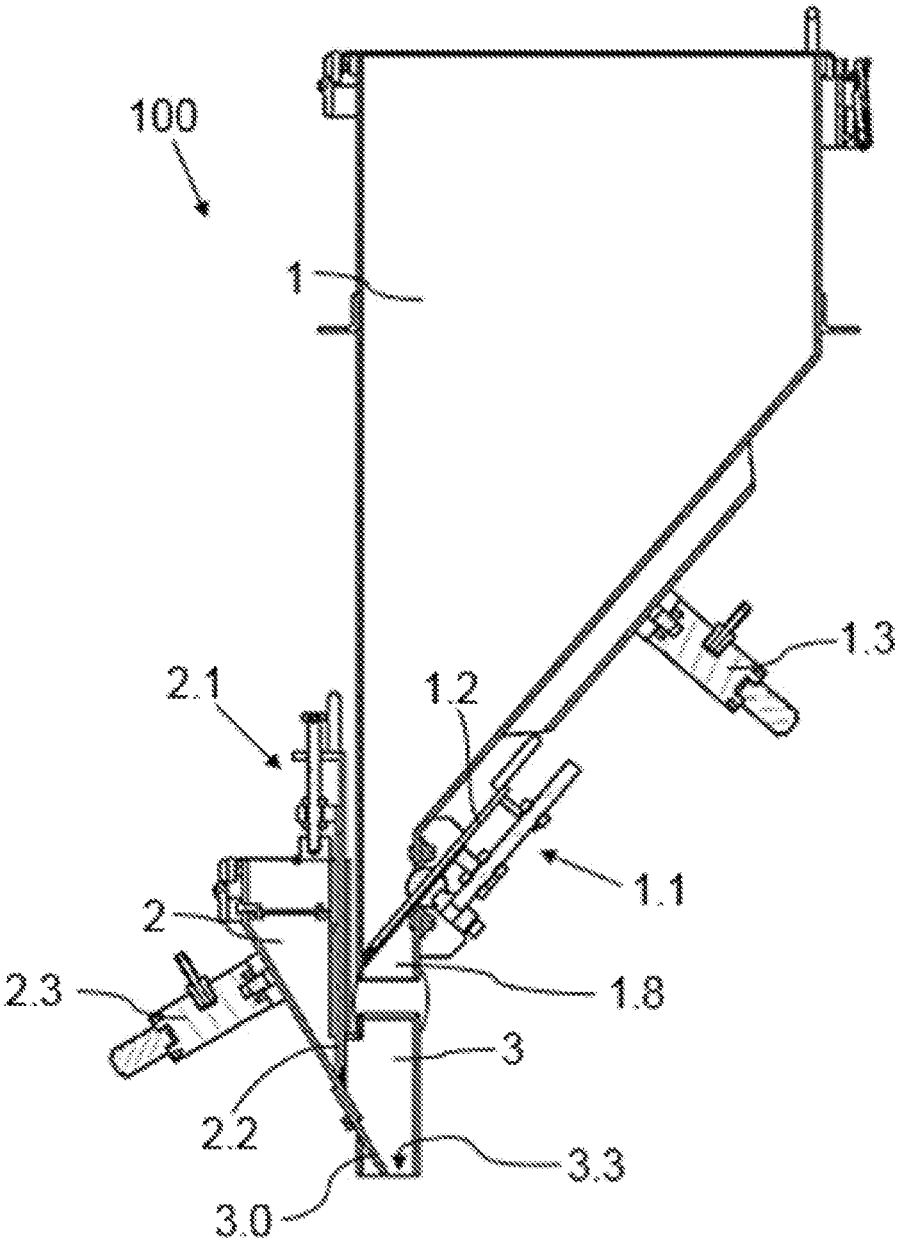
FIG. 3 shows a section view of the apparatus of FIGS. 1A and 1B with the passage of the dosing devices of the apparatus closed.

In some embodiments of the apparatus 100, each regulating device 1.1 and 2.1 further comprises a respective closure element 1.2 and 2.2 shown in a closed position in FIG. 3 by way of example, parallel to and opposite the corresponding regulating element and arranged above said regulating element. Each of said regulating elements is furthermore independently attached to the closure element 1.2 and 2.2 of each regulating device 1.1 and 2.1 with freedom of relative longitudinal movement.

The closure element 1.2 of the first regulating device 1.1 is suitable for allowing or impeding the passage of sand towards the mixing chamber 3, whereas the associated regulating element is suitable for regulating the flow of sand towards said mixing chamber 3. Likewise, the closure element 2.2 of the second regulating device 2.1 is suitable for allowing or impeding the passage of sand towards the mixing chamber 3, whereas the associated regulating element 2.0 is suitable for regulating the flow of solid additive towards said mixing chamber 3.

In some embodiments, the apparatus 100 comprises a vibration device 1.3 associated with the first dosing device 1, to cause the vibration thereof and thereby facilitate or accelerate the supply of the first component to the mixing chamber 3, if required, and/or a vibration device 2.3 associated with the second dosing device 2, to cause the vibration thereof and thereby facilitate or accelerate the supply of the second component to the mixing chamber 3, if required.

In the embodiments in which the apparatus 100 comprises a vibration device associated with more than one dosing devices 1 and 2, in order to prevent the vibrations of one dosing device from affecting the other dosing device, the apparatus 100 comprises attachment means impeding this drawback, isolating the two dosing devices 1 and 2. In the embodiment shown in the figures, for example, the apparatus 100 comprises a vibration device 1.3 associated with the first dosing device 1 and a vibration device 2.3 associated with the second device 2. In order to prevent the vibrations of one from affecting the other, in this case the first dosing device 1 and the mixing chamber 3 are physically separated, the apparatus 100 comprising a hollow and flexible attachment element 4 attaching the first dosing device 1 with the mixing chamber 3 (by way of attachment means isolating vibrations), thereby allowing communication between both and the supply of sand. The second dosing device 2 and the mixing chamber 3 are attached to one another, and they can even be part of one and the same body. In a preferred embodiment, the first dosing device 1 is arranged above the mixing chamber 3, as discussed above. In said embodiment, the attachment element 4 is coupled to the outlet segment 1.8 of the first dosing device 1 and to the mixing chamber 3, on the outside. Therefore, since the attachment element 4 is hollow, the sand reaches the mixing chamber 3 from the first dosing device 1 despite the physical separation between both. As discussed, the attachment element 4 is flexible, such that it absorbs the vibrations generated in the first dosing device 1 by means of the vibration device 1.3 and prevents them from being transferred to the mixing chamber 3.

A second aspect relates to a mixing method for preparing the material used for making sand cores in a mixing apparatus in which sand and at least one solid additive are mixed with one another. The solid additive can be wood flour or starch, for example. For the purpose of mixing them, the sand and the solid additive are supplied to a vertical mixing chamber of the apparatus from a sand dosing device and a respective solid additive dosing device. The mixing chamber has a rectangular cross-section, the contour of the mixing chamber therefore being formed by four side walls, such that two side walls opposite one another are wider than the other two side walls opposite one another. The expression "rectangular section" must be interpreted in the same way discussed for the mixing chamber of the first aspect of the invention. In the method of the invention, the mixing chamber receives the solid additive through one of its wider side walls and at a lower height than the height at which it receives the sand.

In the method, the sand is thus introduced into the mixing chamber from a greater height than the height from which the solid additive is introduced, and due to the falling force of the sand (for the most part at least caused by gravity), since the mixing chamber is vertical, and the cross-section of the mixing chamber, the sand and the solid additive are mixed in a simple and easy manner without having to use additional mechanical elements such as blades, or mixers of another type, for example, or a pre-mixture between both components (sand and solid additive) which must subsequently come into contact with one of said elements for a shorter time for a final mixing being achieved.

In some embodiments of the method, the sand can be directed to a specific area of the mixing chamber when it is supplied, and the same occurs with the solid additive and with both components together. The explanation given in this regard for the first aspect of the invention is also valid for the method and will not be repeated.

Therefore, in some embodiments of the method the flow of sand and/or of solid additive can be adjusted, and the explanation given in this regard for the first aspect of the invention is also valid for the method and will not be repeated.

In a mixing cycle, a given amount of sand is mixed with a given amount of solid additive for a certain amount of time, and in order for the mixture to be homogenous the flow of each (sand and solid additive) is adjusted. If the same mixture is to be prepared after performing a packaging cycle, the flows of sand and solid additive are kept as in the previous mixing cycle. However, if a proportion is required or different amounts are required, the flow of at least one of the two must be adjusted so that the new mixture is homogenous. In some embodiments of the method, the adjustment of said flow (or said flows) is performed before starting the supply of sand and solid additive to the mixing chamber. During adjustment, the sand is prevented from leaving the sand dosing device and the solid additive is prevented from leaving the solid additive dosing device, keeping the passage to the outlet of both dosing devices closed (see FIG. 3), said passages being open once the required adjustment is performed (see FIG. 2).

In some embodiments, in order to cause, facilitate or accelerate the supply of the sand, vibration of the sand dosing device is caused during said supply, and/or in order to cause, facilitate or accelerate the supply of the solid additive, vibration of the solid additive dosing device is caused during said supply.

All the features described in connection with the apparatus 100 of the first aspect are also understood as having been described for the method of the second aspect.

The following clauses represent additional embodiments.

Clause 1: A solid component mixing apparatus for preparing the material used for making sand cores, the apparatus (100) comprising a mixing device and at least a first dosing device (1) for supplying sand and a second dosing device (2) for supplying a solid additive that are communicated with the mixing device, the mixing device comprising a vertical mixing chamber (3) with a rectangular cross-section, the contour of the mixing chamber (3) therefore being formed by four side walls, such that two side walls opposite one another are wider than the other two side walls opposite one another, the mixing chamber (3) having a first inlet (3.1) communicated with the first dosing device (1), and a second inlet (3.2) communicated with the second dosing device (2), the second inlet (3.2) being at a lower height than the first inlet (3.1), and said second inlet (3.2) being arranged in one of the wider side walls of the mixing chamber (3), the solid component mixing apparatus further comprising a baffle (1.0) that is suitable for directing the sand towards the wall of the mixing chamber (3) comprising the second inlet (3.2).

Clause 2: Solid component mixing apparatus according to clause 1, wherein the baffle (1.0) is attached to the first dosing device (1).

Clause 3: The solid component mixing apparatus according to clause 1 or 2, comprising an additional baffle (3.0) that extends at least partially into the mixing chamber (3) through the second inlet (3.2) and is suitable for directing the solid additive towards the wall of the mixing chamber (3) opposite the wall comprising the second inlet (3.2), a passage area (3.3) through which the sand and the solid additive pass being demarcated between the end of the additional baffle (3.0) and said wall, the additional baffle (3.0) preferably being attached to the second dosing device (2).

Clause 4: The solid component mixing apparatus according to clause 3, comprising a first regulating device (1.1) for adjusting, as required, the flow of sand at the outlet of the first dosing device (1), and a second regulating device (2.1) for adjusting, as required, the flow of solid additive at the outlet of the second dosing device (2).

Clause 5: The solid component mixing apparatus according to clause 4, wherein the first dosing device (1) is arranged above the mixing chamber (3) and comprises an outlet segment (1.8) with a cross-section opposite an upper face of said mixing chamber (3), the first inlet (3.1) of the mixing chamber (3) being arranged on said upper face, the first regulating device (1.1) comprising a movable regulating element demarcating the passage width between its end and the wall of the outlet segment (1.8) opposite said end, said wall being substantially aligned with the wall of the mixing chamber (3) comprising the second inlet (3.2).

Clause 6: The solid component mixing apparatus according to clause 5, wherein the baffle (1.0) attached to the first dosing device (1) and the regulating element of the first regulating device (1.1) are one and the same element.

Clause 7: The solid component mixing apparatus according to clause 5 or 6, wherein the second regulating device (2.1) comprises a movable regulating element (2.0) that is at least partially opposite the second inlet (3.2) for adjusting the outflow of solid additive, partially covering said second inlet (3.2) from above to perform said adjustment, thereby limiting the area of said second inlet (3.2) through which solid additive is supplied.

Clause 8: The solid component mixing apparatus according to clause 7, wherein the regulating device (1.1) is attached to the first dosing device (1) with rotational freedom, thus being suitable for adjusting the flow of the corresponding component, or for participating in the adjustment, by means of the rotation thereof.

Clause 9: The solid component mixing apparatus according to clause 7 or 8, wherein each regulating device (1.1, 2.1) further comprises a respective closure element (1.2, 2.2) parallel to and opposite the corresponding regulating element (2.0) and arranged above said corresponding regulating element (2.0), each of said closure elements (1.2, 2.2) being attached to said corresponding regulating element (2.0) with freedom of relative longitudinal movement.

Clause 10: The solid component mixing apparatus according to any of clauses 5 to 9, comprising a vibration device (1.3, 2.3) associated with at least one of the dosing devices (1, 2) to cause the vibration thereof.

Clause 11: The solid component mixing apparatus according to clause 10, comprising a first vibration device (1.3) associated with the first dosing device (1) and a second vibration device (2.3) associated with the second dosing device (2), at least one of the dosing devices (1, 2) being physically separated from the mixing chamber (3), and the apparatus (100) comprising attachment means for attaching said dosing device (1, 2) with the mixing chamber (3), which absorb the vibration of said dosing device (1, 2) and through which said dosing device (1, 2) and the mixing chamber (3) are communicated.

Clause 12: The solid component mixing apparatus according to clause 11, wherein the attachment means comprise a hollow and flexible attachment element (4) which is coupled on the outside to the dosing device (1, 2) and to the mixing chamber (3).

Clause 13: A mixing method for preparing the material used for making cores in a solid component mixing apparatus according to any of the preceding clauses, to make a mixture, the flow of sand and/or of the solid additive at the outlet of the respective dosing device is adjusted before the sand and the solid additive are supplied to the mixing chamber, and the passage to the outlet of both dosing devices is closed, said passages being open once the required adjustment is performed.

Clause 14: The mixing method according to clause 13, wherein vibration of the sand dosing device is caused while sand is being supplied, and/or vibration of the solid additive dosing device is caused while solid additive is being supplied.

What is claimed is:

1. A solid component mixing apparatus for preparing a material used for making sand cores, the solid component mixing apparatus comprising:

a vertically extending mixing chamber with a rectangular cross-section, the contour of the vertically extending mixing chamber being formed by first, second, third and fourth vertically extending sidewalls, the first and second vertically extending sidewalls arranged facing one another and the third and fourth side vertically extending walls arranged facing one another, the first and second vertically extending sidewalls respectively having a first width and a second width, the second and third vertically extending sidewalls respectively having a third width and a fourth width, each of the first and second widths being greater than each of the third and fourth widths, the vertically extending mixing chamber having a through passage extending between and through a first end and a second end of the vertically extending mixing chamber, the first end being located above the second end;

a first dosing device having an inlet through which a sand is introduced into the first dosing device, and an outlet communicated with the vertically extending mixing chamber for supplying the sand into the vertically extending mixing chamber;

a second dosing device having an inlet through a solid additive is introduced into the second dosing device, and an outlet communicated with the vertically extending mixing chamber for supplying a solid additive into the vertically extending mixing chamber:

the vertically extending mixing chamber having a first inlet communicated with the outlet of the first dosing device and a second inlet communicated with the outlet of the second dosing device, the second inlet of the vertically extending mixing chamber being located below the first inlet of the vertically extending mixing chamber and arranged in the first vertically extending sidewall of the vertically extending mixing chamber; and a first baffle configured to direct the sand inside the first dosing device towards the first vertically extending wall of the vertically extending mixing chamber.

2. The solid component mixing apparatus according to claim 1, wherein the first baffle is attached to the first dosing device.

3. The solid component mixing apparatus according to claim 1, wherein the first baffle is configured to direct the sand towards a location of the first vertically extending sidewall, the location being located above the second inlet of the vertically extending mixing chamber.

4. The solid component mixing apparatus according to claim 3, further comprising a second baffle that extends at least partially into the vertically extending mixing chamber through the second inlet, the second baffle configured to direct the solid additive inside the second dosing device towards the vertically extending second sidewall of the vertically extending mixing chamber, a passage area through which the sand and the solid additive pass being demarcated between an end of the second baffle and the vertically extending second sidewall.

5. The solid component mixing apparatus according to claim 4, further comprising a first regulating device that is configured to alter the flow of the sand at the outlet of the first dosing device, and a second regulating device configured to alter the flow of the solid additive at the outlet of the second dosing device.

6. The solid component mixing apparatus according to claim 5, wherein the first dosing device is arranged above the vertically extending mixing chamber and comprises an outlet segment communicated with the first inlet of the vertically extending mixing chamber, the outlet segment having a vertically extending wall, the first regulating device including a first movable regulating element demarcating a passage width between an end of the first movable regulating element end and the vertically extending wall of the outlet segment.

7. The solid component mixing apparatus according to claim 6, wherein the first baffle constitutes the first moveable regulating element.

8. The solid component mixing apparatus according to claim 5, wherein the second regulating device comprises a second movable regulating element that is moveable to alter an area of the second inlet of the vertically extending mixing chamber.

9. The solid component mixing apparatus according to claim 8, wherein each of the first and second regulating devices respectively include a first closure element and a second closure element, the first and second closure elements being respectively attached to the first and second moveable regulating elements with freedom of longitudinal movement.

10. The solid component mixing apparatus according to claim 5, wherein the first regulating device is attached to the first dosing device with rotational freedom.

11. The solid component mixing apparatus according to claim 5, further comprising a first vibration device coupled with the first dosing device and a second vibration device coupled with the second dosing device, the first dosing device being physically separated from the vertically extending mixing chamber, the solid component mixing apparatus comprising a duct that attaches the first dosing device with the vertically extending mixing chamber, the duct being configured to absorb vibrations imparted to the first dosing device by the vibration device and to communicate the first dosing device with the vertically extending mixing chamber.

12. The solid component mixing apparatus according to claim 1, further comprising a second baffle that extends at least partially into the vertically extending mixing chamber through the second inlet, the second baffle configured to direct the solid additive inside the second dosing device towards the second vertically extending sidewall of the vertically extending mixing chamber, a passage area through which the sand and the solid additive pass being demarcated between an end of the second baffle and the vertically extending second sidewall.

13. The solid component mixing apparatus according to claim 12, wherein the second baffle is attached to the second dosing device.

14. The solid component mixing apparatus according to claim 1, wherein the first baffle is attached to the first dosing device and is configured to direct the sand towards a location of the vertically extending first sidewall, the location being located above the second inlet of the vertically extending mixing chamber, the solid component mixing apparatus further comprising a second baffle attached to the second dosing device that extends at least partially into the vertically extending mixing chamber through the second inlet, the second baffle configured to direct the solid additive inside the second dosing device towards the vertically extending second sidewall of the vertically extending mixing chamber, a passage area through which the sand and the solid additive pass being demarcated between an end of the second baffle and the vertically extending second sidewall.

15. The solid component mixing apparatus according to claim 1, wherein one or both of the first and second dosing devices is equipped with a vibration device to cause the one or both of the first and second dosing devices to vibrate.

16. The solid component mixing apparatus according to claim 1, further comprising a first vibration device coupled with the first dosing device, the first dosing device being physically separated from the vertically extending mixing chamber, the solid component mixing apparatus comprising a duct that attaches the first dosing device with the vertically extending mixing chamber, the duct being configured to absorb vibrations imparted to the first dosing device by the vibration device and to communicate the first dosing device with the vertically extending mixing chamber.

17. The solid component mixing apparatus according to claim 16, wherein the duct is made is made of a flexible material.

18. The solid component mixing apparatus according to claim 1, further comprising a first vibration device coupled with the second dosing device, the second dosing device being physically separated from the vertically extending mixing chamber, the solid component mixing apparatus comprising a duct that attaches the second dosing device with the vertically extending mixing chamber, the duct being configured to absorb vibrations imparted to the second dosing device by the first vibration device and to communicate the second dosing device with the vertically extending mixing chamber.

19. The solid component mixing apparatus according to claim 18, wherein the duct is made of a flexible material.

20. The solid component mixing apparatus according to claim 1, further comprising a first vibration device coupled with the first dosing device and a second vibration device coupled with the second dosing device, the second dosing device being physically separated from the vertically extending mixing chamber, the solid component mixing apparatus comprising a duct that attaches the second dosing device with the vertically extending mixing chamber, the duct being configured to absorb vibrations imparted to the second dosing device by the second vibration device and to communicate the second dosing device with the vertically extending mixing chamber.

* * * * *